United States Patent [19]

Lamm

[11] 4,030,458

[45] June 21, 1977

[54] ROTARY PISTON ENGINE

[76] Inventor: August Uno Lamm, 365 Moseley Road, Hillsborough, Calif. 94010

[22] Filed: Jan. 29, 1975

[21] Appl. No.: 544,870

Related U.S. Application Data

[63] Continuation of Ser. No. 383,802, July 30, 1973, abandoned, and a continuation-in-part of Ser. No. 264,807, June 21, 1972, Pat. No. 3,799,035, which is a continuation of Ser. No. 878,637, Nov. 21, 1969, abandoned.

[52] U.S. Cl. ..... 123/44 D; 123/44 E

[51] Int. Cl.[2] ..... F02B 57/02

[58] Field of Search ..... 123/44 D, 44 E

[56] References Cited

UNITED STATES PATENTS

| | | | |
|---|---|---|---|
| 1,184,651 | 5/1916 | Johnston | 123/44 E |
| 1,336,846 | 4/1920 | Lewis | 123/44 E |
| 3,431,894 | 3/1969 | Allred | 123/8.45 |
| 3,854,460 | 12/1974 | Raptis | 123/44 D |
| 3,855,978 | 12/1974 | Becker | 123/44 D |

FOREIGN PATENTS OR APPLICATIONS

| | | | |
|---|---|---|---|
| 1,372,166 | 10/1964 | France | 123/44 E |

*Primary Examiner*—Clarence R. Gordon
*Attorney, Agent, or Firm*—Flehr, Hohbach, Test

[57] ABSTRACT

A rotating piston engine for use as a combustion engine, air or gas compressor, water or hydraulic pump or motor, and the like. A stator supports a rotor which is bored to receive a double acting piston journalled on the crank of an eccentric mounted crankshaft. The crankshaft penetrates the rotor and cylinder wall in a manner to reduce the overall dimensions of the engine. Inlet and outlet ports are provided with a slide valving arrangement adapted for operation in four-stroke cycle combustion engines.

5 Claims, 8 Drawing Figures

ROTARY PISTON ENGINE

CROSS-REFERENCE TO RELATED APPLICATION

This is a continuation of application Ser. No. 383,802 filed July 30, 1973, now abandoned and is a continuation-in-part of application Ser. No. 264,807 filed June 21, 1972 U.S. Pat. No. 3,799,035 issued Mar. 26, 1974, which in turn is a continuation of application Ser. No. 878,637 filed Nov. 21, 1969 now abandoned.

BACKGROUND OF THE INVENTION

FIG. 1 illustrates a prior art rotary piston engine 7 which has been suggested for use as a prime mover, fluid pump or motor, and the like. Engine 7 includes a cylindrical rotor 10 mounted within a housing or stator 11. The rotor is formed along a diameter with a circular bore to provide a double-acting cylinder 12. A double-faced piston 13 is mounted for movement axially of cylinder 12 and is journalled on a crank 14 of crankshaft 15, which in turn is connected with a driving or driven shaft, not shown. The crankshaft is carried on bearings in stator 11 so that its axis of rotation 8 is parallel with the axis 9 of the rotor, with the distance between the two axes being equal to the throw radius $r$ of the crank.

Rotor 10 will turn with an even angular velocity when crankshaft 15 is turned with an even angular velocity double that of the rotor. Piston 13 will move from one end of the cylinder to the other end as the crankshaft completes one revolution and the rotor completes one-half revolution. Total travel for piston 13 during this cycle is equal to $4r$.

The above-described type of engine provides advantages in that all of the principal engine elements move with purely rotational movement. This simplifies balancing of the moving parts to avoid objectionable vibrations. Also, no connecting rods are required between the piston and crank.

One disadvantage of the described prior art engine is that a relatively large opening is required in the rotor and cylinder wall to accommodate shaft 14 throughout all of its angular positions. This requires a relatively large overall size and diameter for the engine.

Inlet and outlet ports can be provided at each side of the stator. When the rotor revolves in a clock-wise direction the piston face will recede from the stator bore surface when the cylinder opening sweeps the right half-circle of the stator, and the piston face will approach the bore surface when sweeping the left half-circle. The intake port will thus be at the right side and the outlet port at the left side of the stator bore. While such ports may facilitate the inlets and outlet connections of simple fluid pumps and motors, the valving problem becomes more acute with the application of such engines as four-stroke cycle combustion engines.

OBJECTS AND SUMMARY OF THE INVENTION

It is a general object of the invention to provide a new and improved rotary piston engine of the character described which obviates the limitations and disadvantages described above.

Another object is to provide a rotary piston engine of the character described which achieves a relative reduction of the overall dimensions of the engine as compared to existing designs.

Another object is to provide a rotary piston engine of the character described which utilizes a novel slide gate valving means for application as a four-stroke cycle combustion engine.

The foregoing and additional objects and features of the invention are provided by means of a stator supporting a rotor which is bored to receive a double acting piston journalled on the crank of an eccentric mounted crankshaft. The crankshaft penetrates the rotor and the cylinder wall in a manner to reduce the overall dimensions of the engine. The invention further provides ports along the circumference of the stator bore for intake and exhaust, with a plurality of arcuate slide valve elements movable in recesses formed in the stator bore with means to move the elements so that they alternately open and close the ports.

DESCRIPTION OF THE PREFERRED EMBODIMENTS

Figure 1:
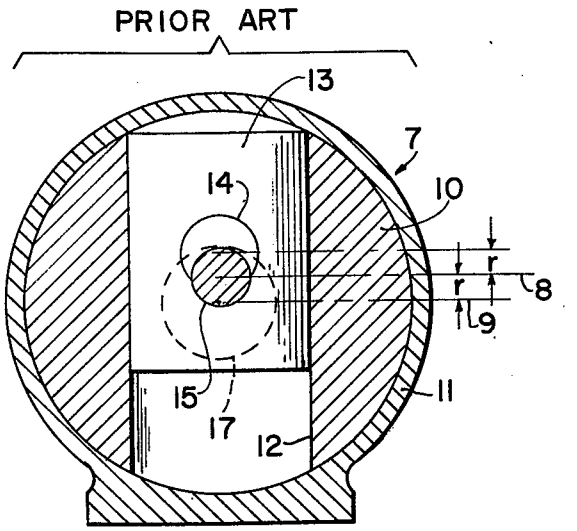
FIG. 1 is a cross-sectional elevational view illustrating a prior art rotating piston engine.

A particular disadvantage in engines of the character heretofore described is that the axial opening through the rotor required to accommodate entry of the crankshaft will be large because of the eccentric location of the shaft relative to the rotor axis. The diameter of this opening will be $d + 2r$, where $r$ is the eccentricity and $d$ is the diameter of the shaft where it penetrates the rotor. This axial opening, in turn, will influence the required length of the piston. The piston must be of sufficient length so that its two end faces remain outside of the opening at the extremeties of piston travel within the cylinder. This is illustrated in FIG. 1 where the circle 17 indicates the opening in the rotor and cylinder wall. The piston 13 must have its lower face extend sufficiently below this opening so that it seals against escape of engine fluid, and the piston must also accommodate one or more piston rings, as required. A longer piston, in turn, means that the diameter of the rotor and the overall size of the engine must be larger.

Figure 2:
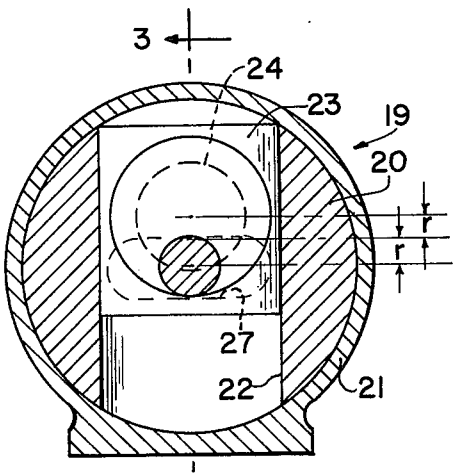
FIG. 2 is a cross-sectional elevational view of a rotary engine constructed in accordance with the invention and taken along the line 2—2 of FIG. 3.
Figure 3:
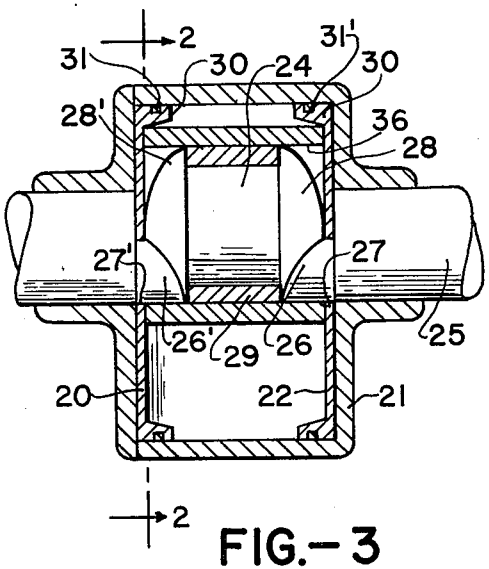
FIG. 3 is an axial section view taken along the line 3—3 of FIG. 2.

FIGS. 2 and 3 illustrate an embodiment of the invention providing an engine 19 which limits the size of the cylinder wall opening that is required to accommodate the crankshaft, thereby providing a relatively smaller overall engine size. Engine 19 includes a rotor 20 mounted for rotation within a stator 21. The rotor is transversely bored to form a cylinder 22 which carries a double acting piston 23, preferably of circular cross-section. A crankshaft 24 is mounted within housing for rotation about an axis eccentrically spaced a distance *r* from the axis of the housing, and a main crank 24 is formed on the crankshaft with a throw radius *r* equal to the eccentric distance *r* in a manner to that explained for the engine of FIG. 1.

Crank 24 is connected to opposite ends of crankshaft 25 by a pair of crank arms 28, 28' connected with shaft entry portions or entry cranks 26, 26' which have the same throw radius *r* as main crank 25 but are angularly displaced 180° relative to the position of the main crank. The entry cranks 26, 26' will thereby make a linear reciprocating motion relative to rotor 20 in a manner similar to that of the main crank. This permits the openings in the cylinder walls 22 which accept the entry cranks 26, 26' to be formed as a pair of rectilinear slots 27 which extend along a diameter of the rotor perpendicular to the axis of cylinder 22. The width of the slots 27 is equal to the diameter *d* of the entry cranks 26, 26' and the slot lengths will be equal to $4r + d$. In comparison with the central shaft entry described above for the prior art device of FIG. 1, the length of the unused central portion of the cylinder will thus be reduced from $d + 2r$ to $d$, with consequent considerable reduction of the required piston length and engine diameter. This difference is evident when comparing the structure of FIG. 2 with that of FIG. 1.

Another useful effect of the entry crank arrangement of the embodiment of FIGS. 2 – 3 is that the entry cranks 26, 26' will assist in driving the rotor from the crankshaft, particularly at the "dead point" of the main crank and piston which would occur in a single-cylinder rotor when the crank is in its lowest position, i.e., is located in the center of the rotor and therefore cannot exercise any torque on the rotor.

While the preferred embodiment of engine 19 illustrates circular cross section configurations for the cylinder and piston, it is understood that these elements could have other cross sectional configurations, such as rectangular or the like. The crank arms 28, 28' which connect the main crank with the entry cranks are shown as having the shape of segments of spheres of approximately the same radius as the cylinder and with their axes coinciding with the axis of the main crank. This configuration achieves the maximum size and rigidity for the crank arms when considering the available space inside of the cylinder.

In order to make it possible to slide piston 23 onto the crankshaft, the piston is formed with a relatively large transverse bore 36. The space between this bore and crank 24 is occupied by a split sleeve 29 which also functions as the crank bearing bushing.

The entire problem of providing entry for the shaft into the cylinder is a problem of interfering as little as possible with the active cylinder length while maintaining sufficient rigidity and strength, including fatigue strength of the shafts, as well as achieving the desired shape and dimensioning of other portions of the shaft. For achieving rigidity it is advantageous to overdimension the other parts of the shaft so that allowed "give" is apportioned to the entry cranks. For fatigue strength, known methods of hollow molding can be utilized where different portions join.

While the illustrated round entry crank configuration with a throw radius *r* represents in many cases optimal solution to the problems discussed above, other shapes and locations of the crank entry portions can also be advantageous. As an example, the opposed faces of the piston 23 could be curved convexly outward, and with the crank entry portion accommodated by an opening in the cylinder wall of similar curved shape. A special case of curved piston face would be an engine of the type described where the crank itself serves as the piston. The invention also contemplates other configurations for the crank entry portion which serve to cover the cylinder openings at the end positions of the piston.

The cylinder openings may be sealed towards the surface of the housing bore by means of suitable seal elements, not shown, located in grooves formed in the rotor surrounding the cylinder openings. The effective area of the opening of a cylinder end could then be the area enclosed by the seal element, i.e., somewhat larger than the cross sectional area of the cylinder. When exposed to the pressure of the working fluid the area difference will then exercise an unbalanced force on the rotor. To eliminate or reduce this force the cylinder wall openings are provided with inwardly extending projections or rims 30, 30' as shown in FIG. 3. Annular seal elements 31, 31' are positioned within grooves formed in these rims. In this way the total area enclosed by the seal elements can be reduced to match the cross sectional area of the cylinder, thereby relieving the rotor from unbalanced pressure forces. These rims can also be enlarged, as desired, to reduce the minimum volume of the combustion chamber in relation to the maximum volume of the chamber.

Figure 4:
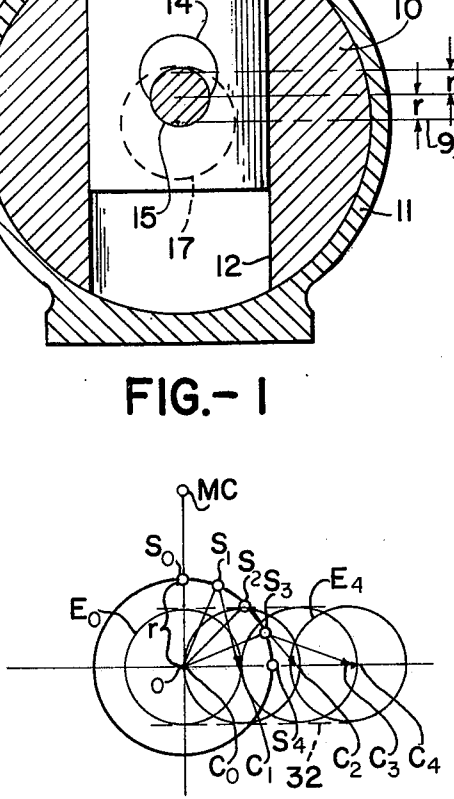
FIG. 4 is a schematic diagram of the calculations for determining the shape of the cylinder wall openings required to accommodate an entry portion of the crankshaft of the rotary engine of the invention.
Figure 5:
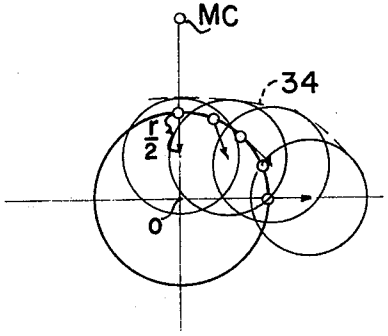
FIG. 5 is a diagram similar to FIG. 4 showing similar calculations for an engine having an crank of relatively smaller throw radius.
Figure 6:
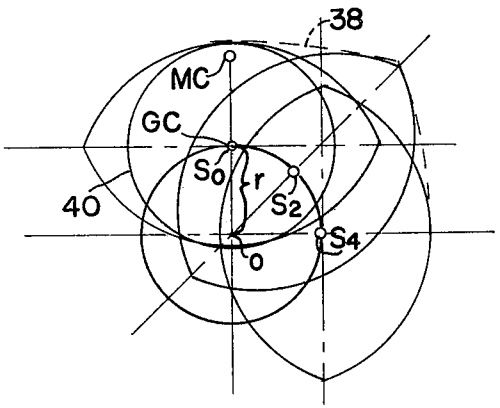
FIG. 6 is a diagram similar to FIG. 4 showing the similar calculations for an engine having an oval cross-section for entry portion of the crankshaft.

FIGS. 4 through 6 graphically illustrate a method for calculating the shape of the cylinder opening that corresponds to specific crank entry configurations. In these cases the rotor is assumed to be stationary while the stator and shaft undergo movement. As the rotor normally turns with half of the angular speed of the shaft, so the stator, including its shaft bearings, will therefore be considered to turn around the rotor axis in one direction while the shaft turns in the opposite direction, both at the same angular rate.

The graph of FIG. 4 shows the calculation of the cylinder wall opening where the entry crank has a throw radius r, as in the embodiment of FIG. 2. The point 0 depicts the center of the fixed rotor while $S_0$, $S_1$, $S_2$. . . depict the successive positions of the center of the shaft bearing in the stator, and $C_0$, $C_1$, $C_2$. . . depict corresponding successive positions of the entry crank centers. The lines $S_0$ - $C_0$, $S_1$- $C_1$. . . depict the radius of the entry crank arm. The point MC depicts the center of the main crank in position $S_0$.

Starting from position $S_0$, where the entry crank's center coincides with point 0, the stator with its shaft bearing center turns clock-wise to position $S_1$, while the entry crank arm turns counterclock-wise in alignment with line $S_1$ - $C_1$. The movements continue through positions $S_2$ - $C_2$ to $S_4$ - $C_4$ during rotation through one quadrant, and the movements are repeated in the other three quadrants. The circles $E_0$ . . .$E_4$ drawn around the centers $C_0$, $C_1$, $C_2$. . . represent cross sections of the entry crank in the different positions, and the envelope 32 of the circles, drawn in dashed lines, defines the entry opening through the cylinder wall, i.e., the slot 27 in the engine of FIGS. 2–3. The left hand portion of the envelope, not shown, is a mirror image of the line 32 shown on the right hand of line 0-$S_0$.

It will be realized that the longitudinal axis of slot 27 will be perpendicular to the cylinder axis if the entry crank is positioned at 180° displacement from the main crank along line $S_0$ - MC. This can be shown by applying the described graphic procedure to the center of the main crank which will then define the cylinder axis.

FIG. 5 shows the case where the throw radius of the entry crank is ½ *r*. Using the graphic procedures described above, it will be seen that the envelope 34, i.e., the entry opening in the cylinder wall, becomes an oval which is wider than the envelope 32 of FIG. 4 in the direction of the cylinder axis but shorter in the transverse direction. This would be advantageous where the piston is a crank pin or has curved faces. The diameter of the entry crank and radius *r* are the same in the two graphs of FIG. 4 and 5 so that the two openings depicted by the envelopes 32 and 34 can be directly compared.

Another means of accommodating a rounded shape of the cylinder wall openings, while strengthening the crank entry portion of the shaft, would be to form the entry crank with an oval cross section. Thus, the graph of FIG. 6 shows a case where an crank entry portion 38 has its geometric center GC located through the rotational axis of the shaft 40, but the entry portion has an oval cross section extending sideways to a greater extend than towards the main crank axis. As the geometric center GC of the entry crank moves clock-wise around the rotor center 0 with the radius *r*, the longitudinal axis of the entry crank turns counterclock-wise through the same angle. The resulting envelope 38, representing the accommodating cylinder wall opening, approaches a rectangular shape. A circle 40 centered at $S_0$ depicts, for purposes of comparison, the section of a circular entry crank which would make the cylinder wall opening extend in the direction of the cylinder axis the same distance as envelope 38. From this comparison it will be realized that the oval cross section for the entry crank achieves a structurally stronger shaft than would be a circular crank. An oval cross sectional configuration for the entry portion would also be advantageous where the entry portion is a crank, i.e., its geometric center is displaced in relation to the center line of the shaft axis. A common feature of the foregoing embodiments which improve the entry of the shaft through the cylinder wall is that the portion of entry has a cross section which extends from the rotational axis of the shaft more in other directions than towards the axis of the main crank.

While the drawings show bearings for the shaft in both end walls of the housing, the invention also contemplates an arrangement in which a shaft bearing would be provided at only one side of the housing.

The invention also contemplates an arrangement in which the same rotor carries two or more cylinders axially spaced apart and in different angular positions. In such case the shaft will have cranks for each piston in each cylinder and in different angular positions. The entry portion of the shaft for each individual cylinder would be arranged as previously described. For example, assume a rotary engine is provided with a rotor having two cylinders arranged perpendicular to each other. The two cranks will then be positioned 180° apart. Assume also that entry cranks are provided as illustrated in FIGS. 2–3 and that the angular position of the main crank for the left hand cylinder is at 0°, i.e., at the twelve o-clock position. The sections of the shaft will then be as follows at axially spaced positions: (1) centered in the left bearing, (2) entry crank at 180°, (3) main crank at 0°, (4) entry crank at 180°, (5) entry crank at 0°, (6) main crank at 180°, (7) entry crank at 0°, (8) centered in right bearing.

For increased structural strength a central section may be provided between the above described sections (4) and (5), i.e., in a central cross section of the rotor. Also, a pair of single-cylinder rotors may be provided to support the shaft in a central bearing, as hereinafter described in relation to the embodiment of FIGS. 7–8. Such an arrangement would be advantageous when the invention is applied to combustion engines where small physical dimensions in relation to power output is of prime importance.

Figure 7:
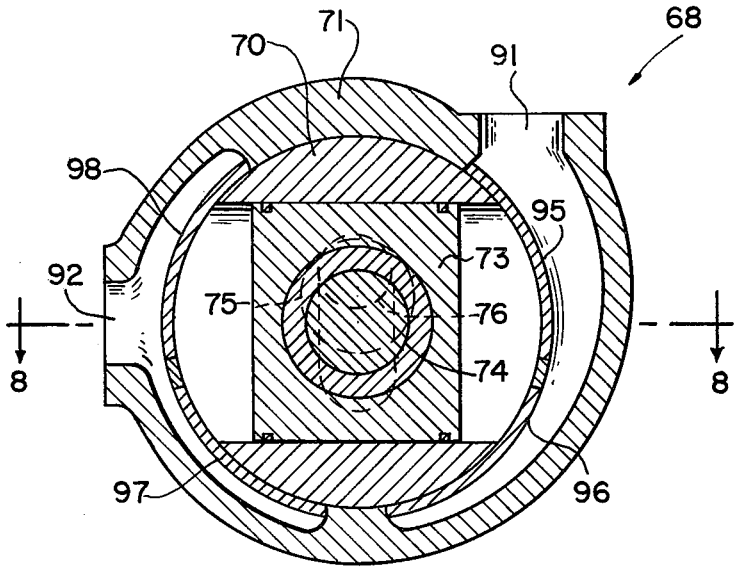
FIG. 7 is a cross-section elevational view of another embodiment of the invention taken along the line 7—7 of FIG. 8.
Figure 8:
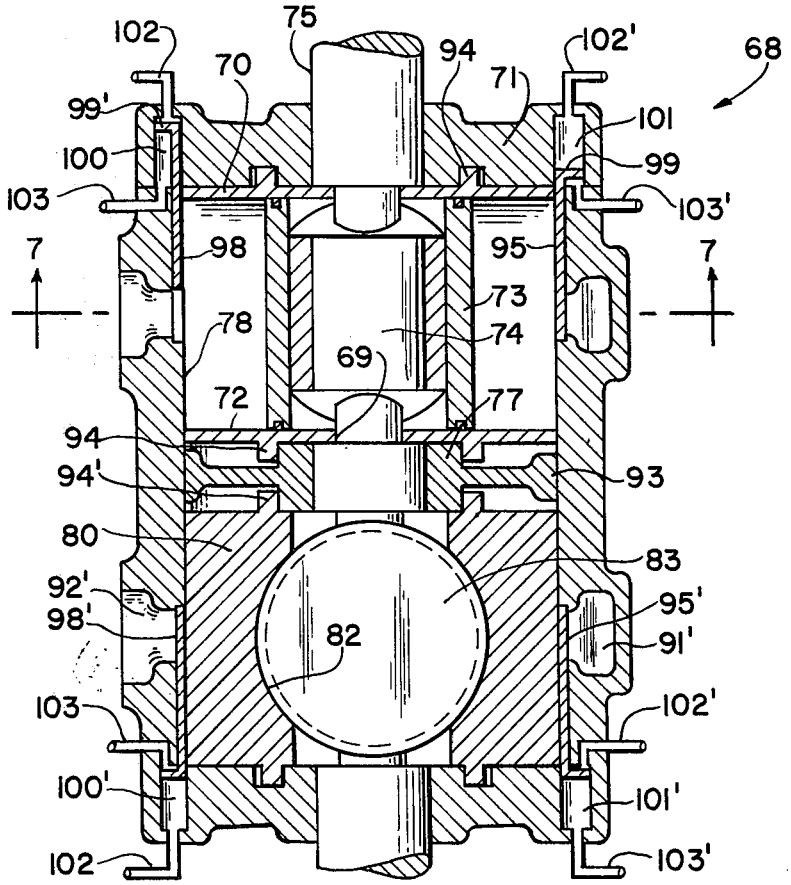
FIG. 8 is an axial sectional view taken along the line 8—8 of FIG. 7.

FIGS. 7 and 8 illustrate another embodiment of the invention providing a rotary engine 68. Engine 68 will have application as a four-stroke cycle internal combustion engine utilizing conventional spark plugs, carburetor, flywheel, lubrication, and rotor and stator cooling provision, now shown. In this embodiment a pair of rotors 70 and 80 are mounted in a common center bore 78 of a stator 71. The rotor 80 is disposed with its cylinder at a 90° angle, and its piston at a 180° angle, relative to the respective cylinder and pistons of the first rotor.

In engine 68 first rotor 70 is journalled within stator 71 on outer bearings 94. This achieves a smaller diameter for the rotor bearing to avoid friction jamming of the rotor drive from the crank-piston arrangement. The first rotor is bored to form a transverse cylinder 72 which is shown in its horizontal position, i.e., perpendicular to a plane through the rotor and shaft axis. A main crank 74 on crankshaft 75 will then be in its lowest position, i.e., concentric with the rotor. Crankshaft 75 is also provided with entry cranks 76 which project through openings 69 in rotor cylinder wall 72 and which will be in their upper position. A piston 73 is carried within cylinder 72 which is mounted on crank 74. Similarly the second rotor 80 is bored to form a transverse cylinder 82 which carries a piston 83 mounted on a crank which, as illustrated, will be in its upper position while the cylinder axis is vertical.

Intake ports 91, 91' and exhaust port 92, 92' are formed in the stator and extend about the circumference so that they are in communication with the cylinder ends during a sufficient time for intake and exhaust functions throughout rotation of the rotor, which is assumed to be in a clock-wise direction as viewed in FIG. 7.

Shaft 75 is journalled for rotation in the opposite stator end walls, and an additional journal bearing 77, positioned between the two rotors, is connected with a flange 93 supported within the stator bore 78. The flange 93 also carries bearings 94, 94' for the opposed ends of the two rotors, and is divided along a plane through the bearings to facilitate assembly.

Engine 68 of FIG. 7 and 8 provides a preferred arrangement for controlling flow through the intake and exhaust ports in accordance with the requirements of a four-stroke cycle internal combustion operation. In the course of rotor revolution each cylinder end faces the intake port substantially while the piston moves away from the stator bore surface, and likewise each cylinder end faces the exhaust port substantially while it approaches the bore surface. In the first case the phase of operation may be either intake or working (combustion), and in the latter case the phase may either be exhaust or compression. Valves are therefore required to alternately close and open the ports.

Ordinary poppet valves have the disadvantage of requiring pockets in the housing wall into which the valve heads move when they open. Combustion gas will accumlate in these pockets on the intake side and will be released into the next cylinder chamber when it passes the valve site for intake, or the gas will be forced towards the carburetor when the valve opens. Similar undesirable results will occur on the exhaust side during the changeover between the compression phase of one cylinder and the exhaust phase of the next cylinder.

Engine 68 provides an improved slide valve arrangement to overcome the foregoing problems. On the intake side of each rotor pairs of slide valve elements 95, 95' 96 are provided, and on the exhaust side pairs of similar valve elements 97, 98, 98' are provided, each of which is formed arcuate in the shape of a section of a cylindrical shell positioned in a recess in the housing bore along the outside of the rotor. Each slide valve element moves in rectilinear axial direction when opening and closing. in the rotor position shown in FIG. 8 slide valve 95 is in closed position and slide valve 98 is in open position. It will be realized that when these valves are closed they do not leave any gas pockets between the rotor and housing.

The slide valves may be operated between their open and closed positions by suitable means such as by pressurized hydraulic fluid directed into chambers 100, 100', 101, 101' through conduits 102, 102' and 103, 103' under influence of suitable hydraulic control means, not shown. The chambers 100, 101 are formed by annular grooves in the housing end faces, and each slide valve element is formed with a flange 99, 99' which fits within a respective groove to act as a piston for reciprocating the slides responsive to pressurized fluid directed into selected ones of the chambers 100, 101 on either side of the valve flanges.

During the four-stroke cycle sequence of operation of engine 68 the four phases will be as follows:

| | Phase 1 | Phase 2 | Phase 3 | Phase 4 |
|---|---|---|---|---|
| First Cylinder Chamber: | intake | compression | work | exhaust |
| Second Cylinder Chamber: | exhaust | intake | compression | work |

It will be realized that each phase represents a one-half revolution of the rotor. This sequence means that each slide can stay in position, either open or closed, during substantially one rotor revolution. By having two valves on each side opening and closing successively there will be ample time for each valve movement. When the slides are arranged along the circumference as shown in FIG. 7, valve movement for each phase may be as long as 40° – 45° in terms of rotation of the rotor. This will require only moderate force for acceleration and deceleration of the valves even at high RPM. Also, valve movement need not be precise inasmuch as the exact rotor angular positions at which intake and exhaust phases begin and end can be defined by the position in the housing of the leading and trailing ends of the inlet and outlet ports.

Another advantage of the slide valve arrangement of the present invention is that the valves need not move when exposed to high combustion or compression pressure, thereby reducing frictional resistance during valve movement.

Gas pockets can also be provided with the present invention in that, with the slides shaped as arcuate sections which move in the housing recesses around the rotor, they will alternatively cover the intake and exhaust openings in the housing or cylinder ends. One advantage to this is that the slides will be adequately cooled as a result of the fact that they alternately face the hot exhaust gases and the cooler intake gases. Each slide may also be operated by forming the same with gear teeth which mesh with gear pinions positioned around the circumference of the engine. The valving operation could also be carried out by a suitable cam shaft arrangement, now shown.

Whether, as described, the slides are arranged to move in axial direction or around the rotor they could, alternatively, be of sufficient length so that they cover the entire axial length of the rotor. The slides would have openings or perforations that register with the stator ports in the open-valve position. Such slides would move in cylindrical interspace between the bore of the stator and the periphery of the rotor. The difference between the radius of said bore and the radius of the rotor would equal the thickness of the slides. This configuration would facilitate machining of the stator bore. Fixed sleeve sections could fill the interspace where no slide valves are located.

In a related modification of the invention the acutal slide valves could extend over only part of the axial length of the rotor. The recess in housing bore, however, would continue along the stator where it faces the rotor. In the interspace so formed another sleeve section or "inactive slide" would be located, angularly extending over the same portion of the circumference as the slide valve. This inactive slide could be movable axially and pressed by springs towards the slide valve. When the latter closes, its front end would strike the end of the inactive slide and push it a fraction of an inch away until the slide valve covers the stator port. This two stage movement would be useful in preventing formation of undesirable carbon deposits in the valving region.

While FIG. 8 shows a cylindrical configuration of the stator bore, other configurations for the bore could also be used, such as a spherical shape. The valve slides and corresponding recesses in which they move would then have a corrresponding spherical shape.

While the embodiments herein are at present considered to be preferred, it will be understood that numerous variations and modifications may be made therein by those skilled in the art and it is intended to cover in the appended claims all such variations and modification as fall within the true spirit and scope of the invention.

I claim:

1. A rotating piston engine comprising the combination of: a stator; a rotor mounted in the stator for rotation about a first axis; means forming a cylinder in the rotor and having its longitudinal axis perpendicular to said first axis; a crankshaft having a first crank with a given throw radius; the crankshaft being mounted in the stator for rotation about a second axis parallel with the first axis and spaced therefrom a distance equal to the throw radius; means forming an elongate opening in said rotor to allow free entry of said crankshaft into said cylinder means, said opening having a length extending laterally of the cylinder and a width extending lengthwise thereof; said crankshaft including an entry portion projecting through said opening means, said entry portion having a cross section which extends from the rotational axis of the shaft more in other directions than towards the axis of said first crank, said entry portion cross section being sized commensurate with the width of the opening for movement along its length.

2. A rotating piston engine as in claim 1 and further characterized in that said entry portion of the crank shaft comprises a second crank positioned in an angular relationship of substantially 180° from said first crank.

3. A rotating piston engine as in claim 2 and further characterized in that said second crank has a throw radius equal to the throw radius of said first crank.

4. A rotating piston engine as in claim 1 and further characterized in that said entry portion is formed with an oval cross section, and the major axis of said oval cross section is substantially perpendicular to a plane passing through the shaft rotational axis and the axis of said first crank.

5. A rotating piston engine as in claim 1 and further characterized in that said means forming the opening in the rotor is configured as the envelope of said entry portion of the shaft which is generated during its motion in relation to the rotor rotation.

* * * * *